US005332331A

United States Patent [19]

Critz et al.

[11] Patent Number: 5,332,331

[45] Date of Patent: Jul. 26, 1994

[54] COMBINATION SPREADER/GRADER APPARATUS

[76] Inventors: Barry L. Critz, P.O. Box 1622; Richard A. Seal, 9002 Road 297, both of Picayune, Miss. 39466

[21] Appl. No.: 32,804

[22] Filed: Mar. 17, 1993

[51] Int. Cl.[5] ..... E01C 19/22; E02F 3/76

[52] U.S. Cl. ..... 404/96; 404/118; 172/393

[58] Field of Search ..... 404/96, 118, 120, 101, 404/119; 172/392, 393, 445.1, 684.5, 738, 117, 692, 693, 445.2, 789

[56] References Cited

U.S. PATENT DOCUMENTS

| | | | |
|---|---|---|---|
| 1,232,314 | 7/1917 | Hubbard | 172/393 |
| 4,320,988 | 3/1982 | Seal | 172/393 X |
| 4,630,686 | 12/1986 | Ausmus, Jr. | 172/393 |
| 4,655,297 | 4/1987 | Bourgeois | 172/445.1 |
| 4,917,533 | 4/1990 | Wilson | 404/101 X |
| 5,191,943 | 3/1993 | Minor et al. | 172/393 |

*Primary Examiner*—Ramon S. Britts
*Assistant Examiner*—James A. Lisehora
*Attorney, Agent, or Firm*—Pravel, Hewitt, Kimball & Krieger

[57] ABSTRACT

An improved spreader/grader apparatus having a pair of substantially parallel sidewalls, spaced apart, and supporting at least two spreader/grader blades therebetween. There would be provided a hydraulic or manual adjustment member connected to at least one end of each of the cutting blades, for allowing the one end to be movably adjusted along the length of the sidewalls, so that the blades may be moved from a position substantially perpendicular to the length of the sidewall, to a position angulated therefore, so as to provide a means to prevent material graded to accumulate along the length of the blades, but to slide along the angulated blade and be deposited outside the grader apparatus. The blades are fixed in their relation to the surface itself, and cannot rotate about an axis.

11 Claims, 6 Drawing Sheets

COMBINATION SPREADER/GRADER APPARATUS

BACKGROUND OF THE INVENTION

1. Field of the Invention

The apparatus of the present invention relates to road working equipment. More particularly, the present invention relates to an improved spreader/grader for working road surfaces, including the ability to angularly adjust the spreader/grader blades in relation to the frame during operation of the apparatus.

2. General Background

In the construction or maintenance of land in general, and particularly roadbeds, it is desirous to have the ability to level the surface of the land, or roadbed, to make travel thereupon more efficient and easier. The present state of the art allows a mechanical spreader/grader to be pulled by a tractor or like vehicle, the spreader/grader having one or more blades along its base which cuts into the roadbed or land surface, and attempts to level the surface as the apparatus is pulled along. One such patented piece of equipment is disclosed and claimed in U.S. Pat. No. 4,320,988, issued James Seal, which provides a spreader/grader attachable to a tractor, with the apparatus having a plurality of blades movably positionable between a pair of upright sidewalls, with the cutting edges of the blades rotatable about an axis to adjust their angular relationship to the surface to be graded, and the blades adjustable up and down to change the depth of the grading. The existing spreader/grader has shortcomings in that the blades are installed at a fixed angle to the length of the side wall. Optimum performance can not be achieved unless the blade angle with respect to the side wall is adjustable to accommodate the grading or spreading conditions. Further, the side walls in the rear of the spreader/grader are inclined away from the rear cutting blade, this does not allow the rear cutting edge to be placed close to a surface such as a wall.

Therefore, it would be advantageous to have introduced into the art a spreader/grader apparatus which improves upon the current state of the art, and which offers a more simplified, yet more functional spreader/grader, which solves the problems in the art. Other prior art spread/graders are noted in the art, and together with the aforementioned Seal apparatus, will be listed in the prior art statement filed with this application.

Other objects of the invention will be obvious to those skilled in the art from the following description of the invention.

SUMMARY OF THE PRESENT INVENTION

The apparatus of the present invention solves the problems in the art in a simple and straightforward manner. What is provided is an improved spreader/grader apparatus having a pair of substantially parallel sidewalls, spaced apart, and supporting at least two spreader/grader blades therebetween. There would be provided a hydraulic or manual adjustment member connected to at least one end of each of the cutting blades, for allowing the one end to be movably adjusted along the length of the sidewalls, so that the blades may be moved from a position substantially perpendicular to the length of the sidewall, to an angular position relative to the length of the sidewall, so as to provide a means to prevent material from being deposited evenly behind the spreader/grader, but to slide along the angulated blade and be deposited in a greater proportion on one side of surface being graded to produce a crowning effect such as is desirable on a road surface.

Further there is provided a frame along the front end of the apparatus to allow it to be connected to a tractor for pulling the apparatus along the surface. The spreader/grader would also include a brazed, hardened surface along each underside of each sidewall, to prevent excessive wear to the apparatus as it is dragged along the ground.

Further there is provided an attachment to the principal apparatus, allowing the apparatus to be utilized on a sharp incline and supported by a wheel member, as the spreading/grading process is taking place.

Therefore, it is a principal object of the present invention to provide a spreader/grader apparatus which includes the ability to change the angular relationship between the grader blade and the frame, for allowing graded material to be moved outside the frame of the apparatus;

It is a further principal object of the present invention to provide a spreader/grader apparatus which allows for the grading/spreading of material in a single direction with fixed blades in relation to the surface being graded;

It is a further object of the present invention to provide a spreader/grader apparatus which has an improved frame design in order to facilitate grading/spreading of the surface material;

It is a further object of the present invention to provide a spreader/grader apparatus which provides an attachment to facilitate spreading/grading along an inclined surface;

It is a further object of the present invention to provide a spreader/grader apparatus which provides that the sidewalls be shaped in such a manner, that the rear edge of the sidewalls be angulated in substantially the angular configuration of the blade, so as to allow the apparatus to be positioned against a flat wall or the like for optimum grading or spreading to that point; and It is a further object of the present invention to provide a spreader/grader apparatus which could provide a pair of stationary blades which would be perpendicular to the sidewalls for the spreading function, and means for angulating the blades in relation to the sidewalls to achieve the optimum grading function.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 8:
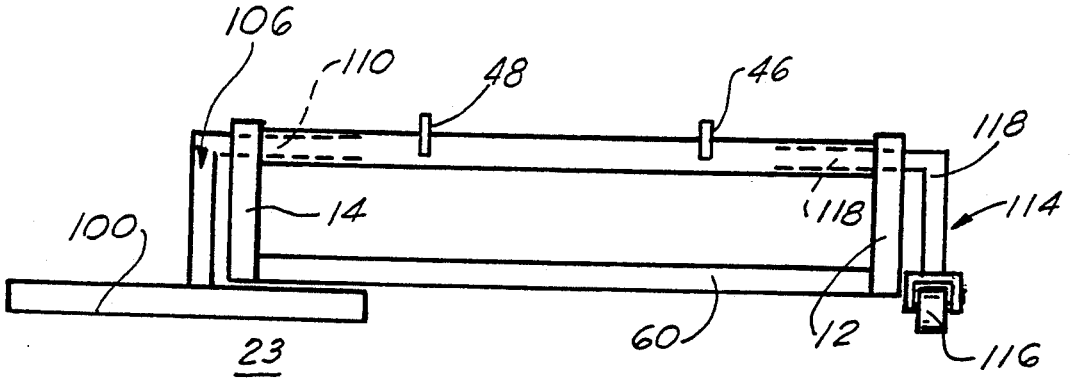
FIGS. 8 and 9 illustrate front and top views respectively of the attachment for cutting along inclined surfaces in the apparatus of the present invention.
Figure 9:
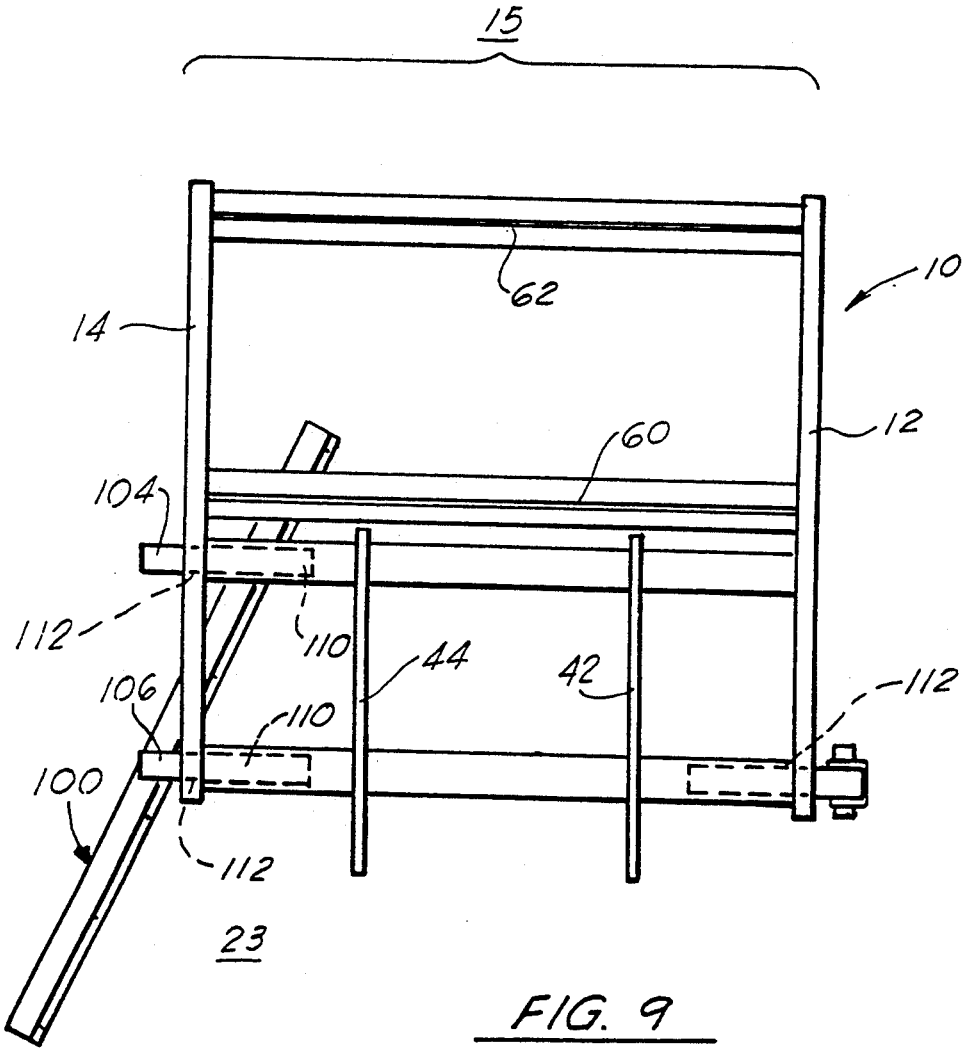
Figure 10:
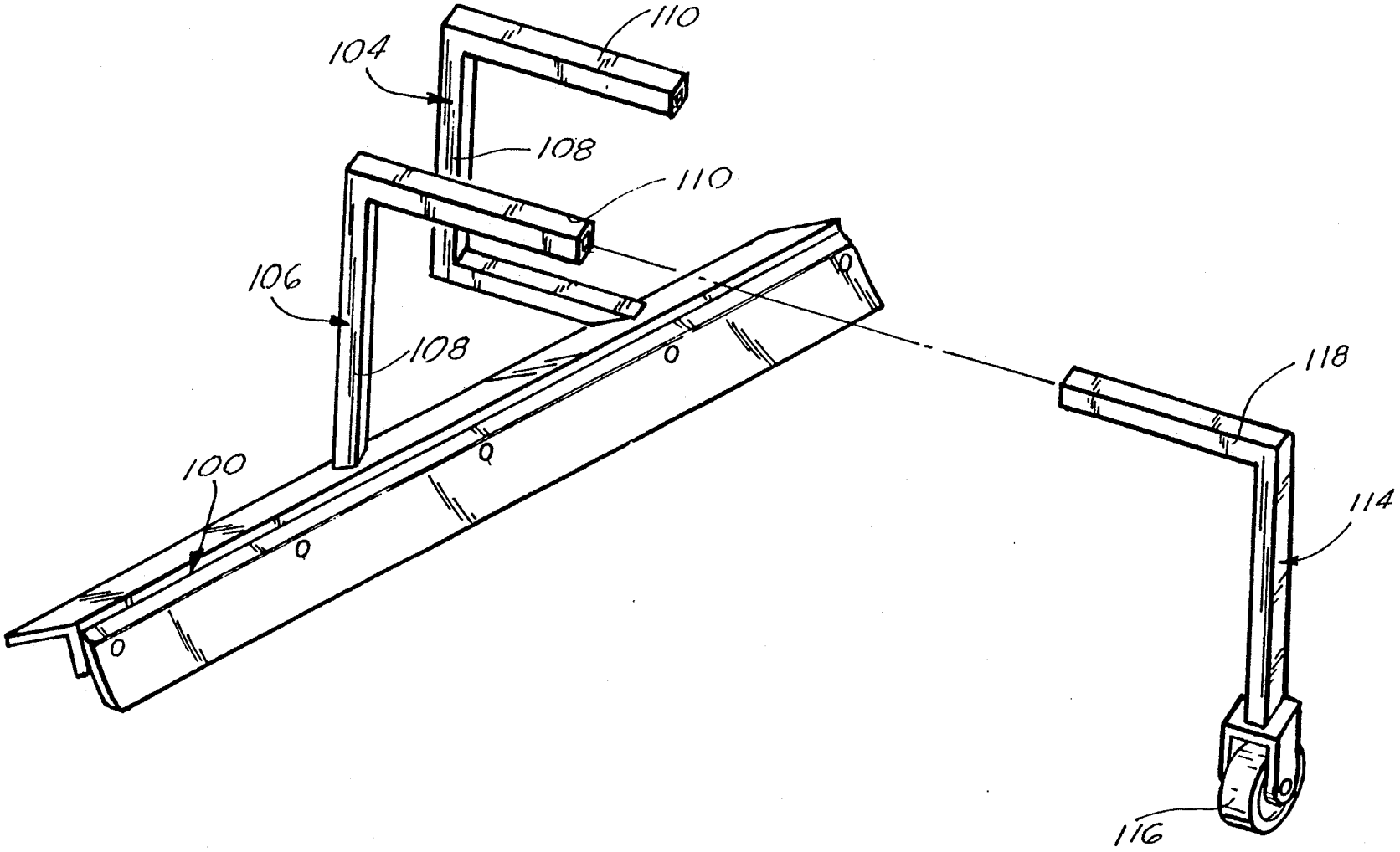
FIG. 10 illustrates a partial view of the attachment of the wheel member onto the attachment frame in the apparatus of the present invention.

FIGS. 1 through 7 illustrate the preferred embodiment of the present invention by the numeral 10. FIGS. 8 through 10 illustrate the attachment member which will be discussed further.

Figure 1:
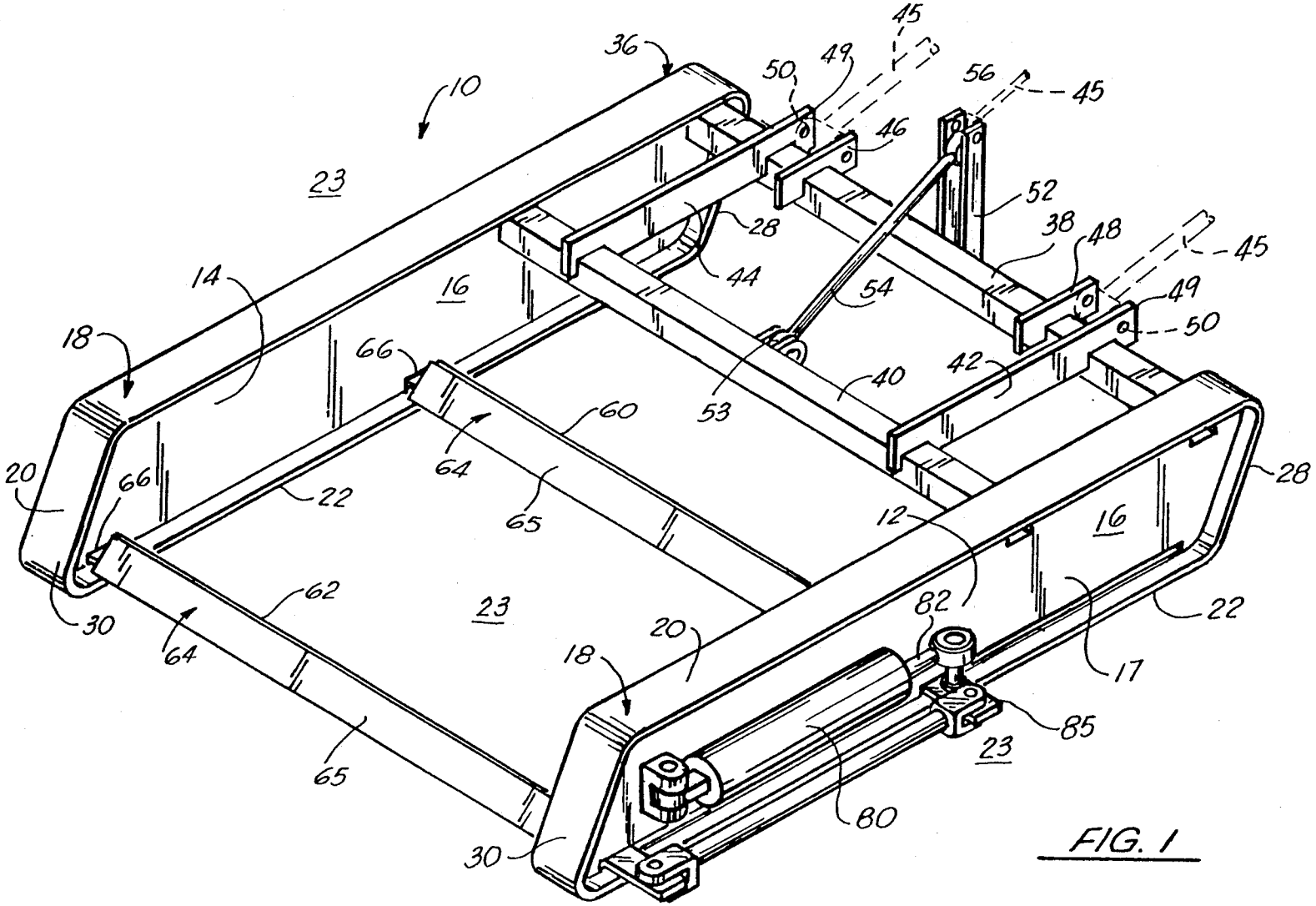
FIG. 1 illustrates an overall view of the preferred embodiment of the present invention with the blades in the perpendicular configuration in relation to the frame.
Figure 2:
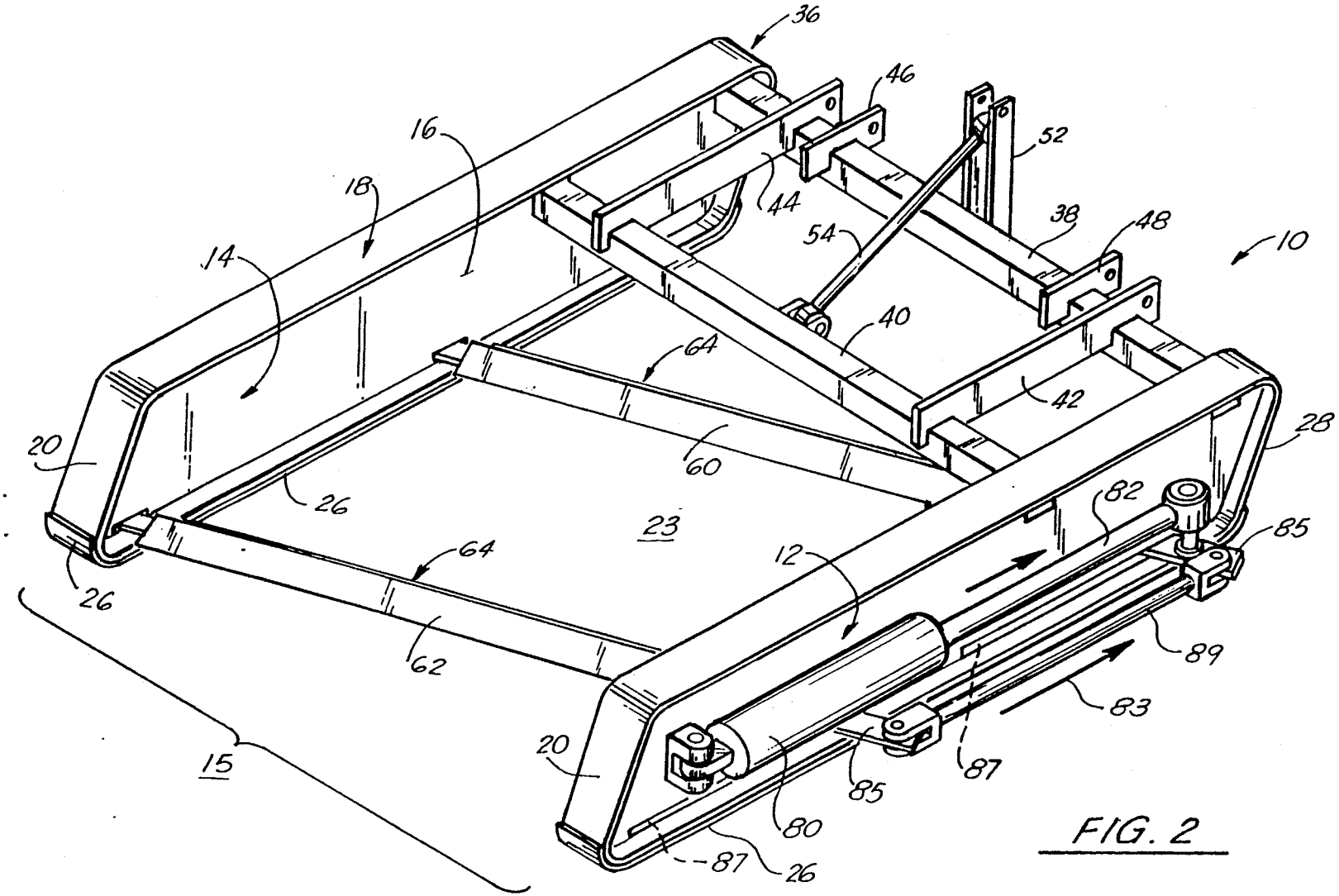
FIG. 2 illustrates an overall view of the preferred embodiment of the present invention with the blades in the angulated configuration in relation to the frame.
Figure 3:
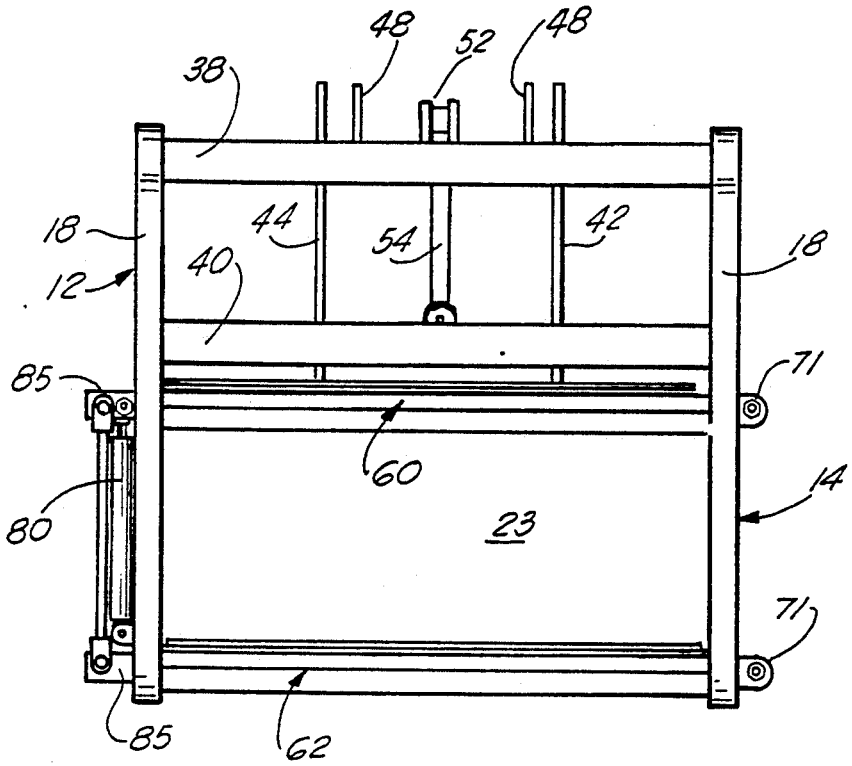
FIGS. 3 and 4 illustrate top view of the configurations illustrated in FIGS. 1 and 2, respectively.
Figure 4:
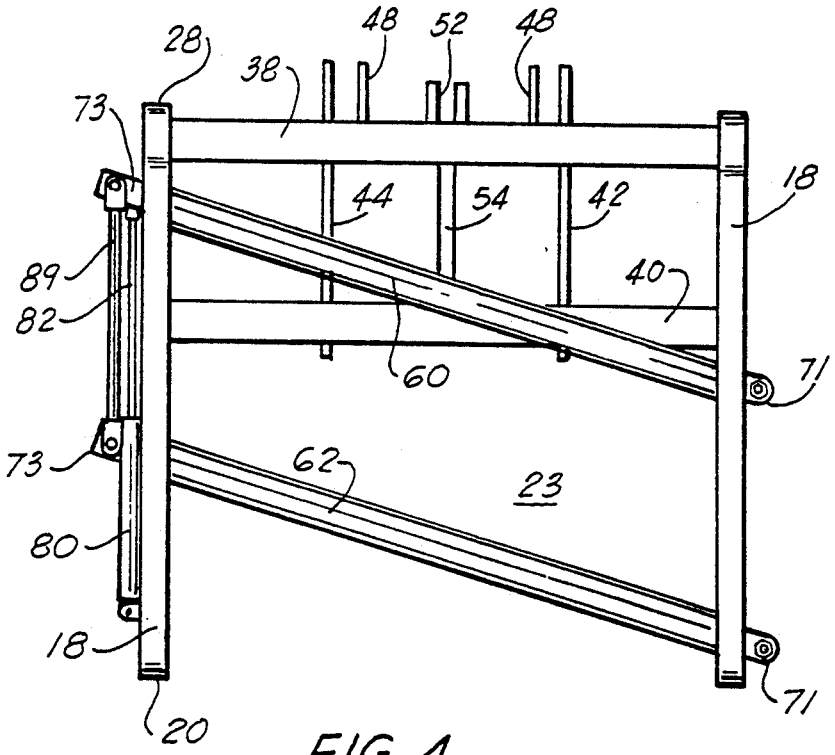
Figure 5:
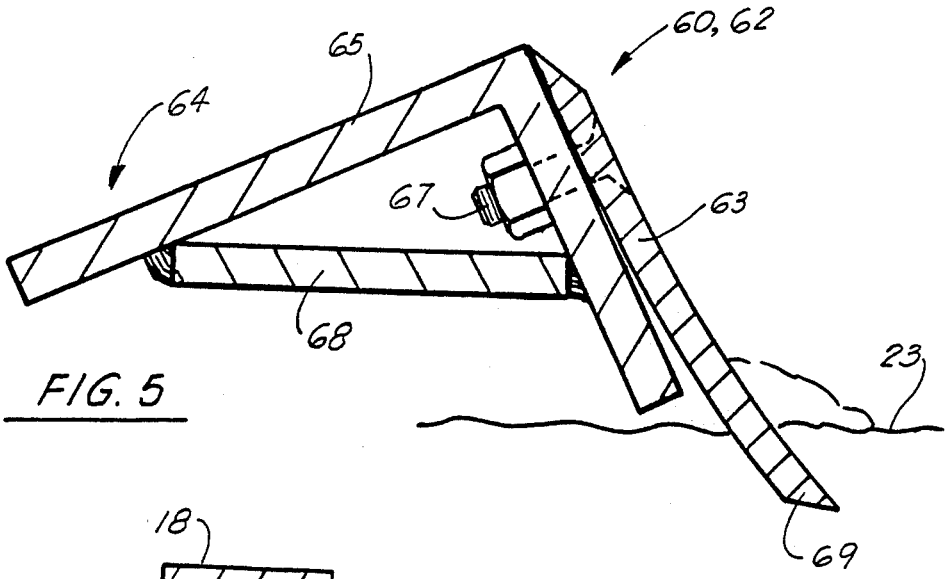
FIG. 5 illustrates a cross-section view of one of the grading/spreading blades in the apparatus of the present invention.
Figure 6:
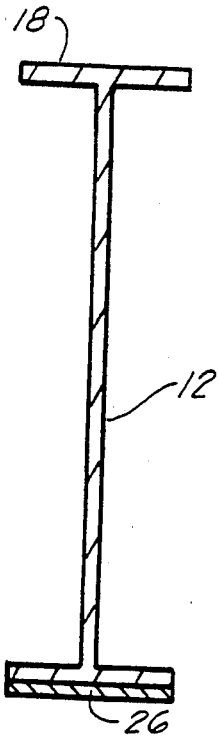
FIG. 6 illustrates a cross section view of one of the sidewall frame members in the apparatus of the present invention.
Figure 7:
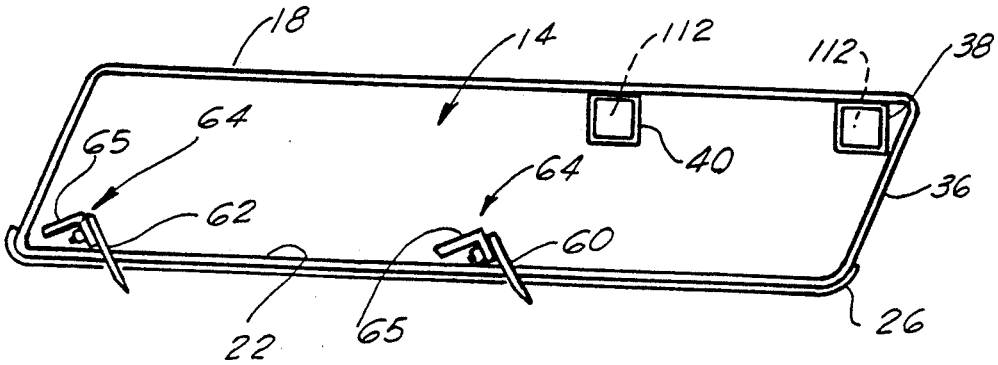
FIG. 7 illustrates a side view of the apparatus of the present invention.

Turning now to FIGS. 1 through 7, grader/spreader apparatus 10 would comprise first and second upright sidewall frame members 12, 14 respectively. Each sidewall 12, 14 would further comprise a central metal sidewall 16, enclosed in a track 18 along its entire perimeter. Track 18 would include an outer surface 20, the lower face 22 of which defines the means upon which the apparatus 10 would move along a surface to be graded or spread. As is seen in FIGS. 1 and 6, there would be included a second outer layer of hardened metal 26, (See FIG. 2) secured through welding or the like to lower face 22 of track 18 to reduce the wear of the lower face 22 while the apparatus is move along the ground.

It should be noted that the configuration of each of the sidewall frame members 12, 14 is more in the shape of a parallelogram than a rectangle, with the forward edge 28 of each of the sidewalls 12, 14 inclined slightly rearward, and the rear edge 30 inclined slightly forward. This configuration is important in guiding the apparatus 10 along the surface, and properly engaging the surface 23 which is being graded or spread.

As seen in the FIGURES, the forward most portion 36 of apparatus 10 includes a means for strengthening the overall apparatus 10, and affording an attachment means to a tractor or the like vehicle which would pull the apparatus. This means includes a pair of parallel bars 38, 40, which would preferably be hollow square bar, welded at their ends to the side walls 12, 14 to provide structural integrity to the apparatus, and to maintain the sidewalls 12, 14 spaced apart along their length. Further as seen in detail in FIGS. 1 and 2, the bars 38, 40 would be interconnected by a pair of support members 42, 44. Also, forward bar 38 would further include a pair of mounting brackets 46, 48, for attaching a tractor hitch 45 (phantom view) thereto. Brackets 46, 48 are provided with a port 50 for providing attachment to the hitch 45. Likewise the forward ends 49 of each bar 42, 44 would also include a port 50 for boltingly engaging the tractor hitch 45 to the apparatus for pulling it. Further there is illustrated a centrally provided mounting hitch 52 secured to forward bar 38, with hitch 52 including a connecting rod 54 extending from the upper end 56 of hitch 52 to the central point of bar 40, so that when it is hitched to a tractor, there is established a "three point hitch" between the tractor and the apparatus. In this manner the tractor operator can maneuver the apparatus upward and downward as needed during the grading/spreading process.

Turning now to the grading/spreading function of apparatus 10, reference is made to FIGS. 1 through 4 in particular. As seen in these figures, there is provided a pair of spaced apart blades 60, 62 extending between the parallel side walls 12, 14. Each blade 60, 62, would be utilized to smooth the surface being graded during use of the apparatus. As illustrated, and as seen in detail in FIG. 5, the blades 60, 62 would further comprise a length of iron 63 extending between the two sidewalls 12, 14. Each blade 60, 62 would be secured against a length of angle iron 65, through a series of bolts 67 along its length. Further each blade 60, 62 would provide a lower cutting edge 69 for digging into the surface 23 to be graded. As illustrated, particularly in FIG. 5, the blade members 60, 62 would be secured to the angle iron 65 so that the blades 60, 62 extends to a point somewhat below the angle iron 65, so that as it is pulled along surface 23, the blade is actually digging into the surface in order to smooth it out. There is further provided a support member 68 welded between the two faces of the angle iron 65, so as to provide the necessary support as the blades 60, 62 plows through the surface 23.

The length of angle iron 65 to which each blade is bolted would provide a stable mounting base 64 for each blade 60, 62 along its entire length. The first end 66 of the angle iron 65 would be hingedly secured at point 71 to the lower face 22 of sidewall 14. The second end 73 of each angle iron 65 would be allowed to move along substantially the entire length of sidewall 12, from a first position perpendicular to the side walls 12, 14 (See FIGS. 1, 3) to a second position where the base 64 has been moved to an angle in relation to sidewalls 12, 14 (See FIGS. 2, 4). The ability of the blades 60, 62 to be moved from the first and second positions serves as a means to adjust the blades to facilitate movement of the graded/spreaded material away from the cutting blades and outside the framework of the apparatus. This eliminates the accumulation of graded material against the forward part of the blade.

This sliding movement of the second end 73 of each blade base 64 would be facilitated either through manual movement by the operator, or as seen in the drawings through the use of hydraulic means. As illustrated in FIGS. 1 through 4, the hydraulic means would comprise a hydraulic cylinder 80 mounted onto the outer face 17 of sidewall 12, with the piston 82 of cylinder 80 extendable along the length of the sidewall 12. Each blade 60, 62 would include an attachment arm 85 extending through a continuous slot 87 in sidewall 12, and each arm 85 connected via a rod 89 to maintain them spaced apart. The end 91 of piston 82 would be engaged to the forward most arm 85, so that as the piston 82 is fully retracted, as seen in FIG. 1, the blades 60, 62 are positioned in the first position, perpendicular to sidewall configuration. When the hydraulic cylinder is activated, as in FIG. 2, the piston 82 has been extended, (arrow 83) which in turn, carries with it the two arms 85 mounted to each blade mount 64, thus moving the blades to the fully angulated position. Of course, during operation, the operator may extend the piston as far out as he feels it should be, thus allowing in adjustability of the blades from the fully retracted to the fully extended, and points in between. Of course, if this were to be accomplished manually, that is without the hydraulics, the blades would have to be secured through bolting or the like at each point that the operator would want to fix their angular position during use. However, in the preferred embodiment it is foreseen that hydraulics would be the preferred means to adjust the position of the blades.

It should be made clear that the blades 60, 62, although adjustable in their relation to the sidewalls lengths, are not adjustable in terms of their angular relation to the surface to be graded. As seen in FIG. 5, there is no provision for rotating the blades about their axis to affect the cutting angle into the surface, nor may the blades by rotated to allow for reversing the apparatus to grade in the opposite direction. Although this may be a limitation, the manner of construction in the preferred embodiment provides a simplified construction, which is very strong, and affords the angular grading as mentioned earlier, which is a great asset to the state of the art.

Reference is now made to FIGS. 8 through 10 which provide for an attachment means for allowing the grader/spreader 10 to be used easily upon an inclined surface. As illustrated, the overall frame 15 would be provided, however, including two important attachment members. The first member is a cutting blade 100, which is constructed identical to cutting blades 60, 62 previously discussed. However cutting blade 100 would further include a pair of mounting arms 104, 106, each arm comprising a first upright portion 108, with a mounting arm portion 110 extending therefrom. Each of the ends of the arm portions 110 would slidable engage into the square bores 112 of the front parallel bars 38, 40, so that once in position, would allow the blade 100 to be positioned as seen in FIG. 9. Further, to support the second side of the frame 15, there would be provided a wheel member 114, comprising a wheel 116, mounted to a mounting arm 118, so that the end of the arm 118 would also slidingly engage into the square bore 112 of support bar 38. Once configured, the frame 15 would be fully supported, with the blade 100 cutting into the surface 23 at one side of the frame 15, and the second side of the frame supported by the wheel 116 rolling along the surface 23. Of course, when the job was complete, the blade 100 and wheel 116 would simply be disengaged, and the frame 15 would return to its principal embodiment to be dragged along the surface 23, with blades 60, 62 cutting the surface.

Glossary of Terms grader/spreader apparatus 10
sidewall frame members 12, 14
overall frame 15
central sidewall 16
outer face 17
track 18
outer surface 20
lower face 22
surface 23
hardened metal 26
forward edge 28
rear edge 30
forward portion 36
parallel bars 38, 40
support members 42, 44
tractor hitch 45
mounting brackets 46, 48
forward ends 49
port 50
mounting hitch 52
connecting rod 54
upper end 56
blades 60, 62
iron length 63
angle iron 65
bolts 67
support member 68
lower cutting edge 69
mounting base 64
first end 66
point 71
second end 73
hydraulic cylinder 80
piston 82
arrow 83
attachment arm 85
slot 87
rod 89
end 91
cutting blade 100
mounting arms 104, 106
upright portion 108
arm portion 110
bores 112
wheel member 114
wheel 116
mounting arm 118

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An improved apparatus for spreading or grading a land surface, and to be pulled by a tractor or like vehicle, the apparatus comprising:

a) a principal frame portion attachable to the tractor, including first and second parallel side walls engaging the surface to be spread or graded;

b) at least one blade positioned between the sidewalls, for cutting into the surface as the apparatus is pulled along the surface; and c) means for moving at least one end of the blade to various positions along a length of one of the sidewalls, so that the blade may be positioned between a position perpendicular to a length of the sidewalls, to angulated positions in relation to a length of the sidewalls.

2. The apparatus in claim 1, further comprising a second blade, spaced apart from the first blade and likewise having at least one end movable along the length of one of the sidewalls on a parallel path as the first blade is moved.

3. The apparatus in claim 1, wherein the means for moving the blade end along the length of the sidewall includes a hydraulic cylinder.

4. The apparatus in claim 1, wherein each of the sidewalls further comprise a hardened steel layer on an underside of the sidewalls to reduce the wear on the face of the sidewalls as the sidewalls contact the surface.

5. The apparatus in claim 1, further comprising a slot in one of the sidewalls for facilitating the connection between the blade and the hydraulic cylinder for moving the blade along the length of the sidewall.

6. The apparatus in claim 1, wherein the blade member is fixed in its position relative to the angle of cut into the land surface.

7. The apparatus in claim 1, wherein the sidewall is configured generally in the shape of a parallelogram, so that the rear edge of the sidewalls are angulated in substantially the same angular position as the rear blade for allowing optimum placement of the apparatus adjacent an upright wall or the like.

8. The apparatus in claim 1, wherein there is provided means to attach to a tractor via a three-point hitch.

9. An improved apparatus for spreading or grading a land surface, and to be pulled by a tractor or like vehicle, the apparatus comprising:

a) a principal frame portion attachable to the tractor, including first and second parallel side walls engaging the surface to be spread or graded;

b) a pair of parallel disposed blades positioned between the sidewalls, for cutting into the surface as the apparatus is pulled along the surface; and c) hydraulic means connected to one end of the blades for moving the one end of the blades to various positions along a length of one of the sidewalls, so that the blade may be positioned between a position perpendicular to a length of the sidewalls, to angulated positions in relation to the length of the sidewalls.

10. An improved apparatus for spreading or grading a land surface, and to be pulled by a tractor or like vehicle, the apparatus comprising:

a) a principal frame portion attachable to the tractor, including first and second parallel side walls engaging the surface to be spread or graded;

b) a pair of parallel disposed blades positioned between the sidewalls, for cutting into the surface as the apparatus is pulled along the surface, first ends of the blades hingedly connected to the frame portion;

d) hydraulic means connected to a second end of the blades for moving the second end of the blades to various positions along the length of one of the sidewalls, so that the blade may be positioned between a position perpendicular to the length of the sidewalls, to angulated positions in relation to the length of the sidewalls; and e) means for attaching a third blade to one portion of the frame, and a wheel member to a second portion of the frame, so that the frame can be pulled along an inclined surface and spreading or grading of the surface can be achieved as the third blade cuts into the inclined surface, and the wheel allows easy maneuvering of the frame along the inclined surface.

11. An improved apparatus for spreading or grading a land surface, and to be pulled by a tractor or like vehicle in a direction, the apparatus comprising:

a) a principal frame portion attachable to the tractor, including first and second parallel side walls engaging the surface to be spread or graded;

b) a pair of substantially parallel blades positioned between the sidewalls, said blade being selectively movable to an angled position relative to the direction of tow and each of the blades cutting into the surface as the apparatus is pulled along the surface; and c) a rear edge of the sidewalls being angulated from the vertical in substantially the same angular configuration as one of the cutting blades, so that when the cutting blade is positioned substantially at the rear edge of the sidewalls, the apparatus is able to be positioned adjacent a vertical structure such as a wall to achieve optimum grading or spreading.

* * * * *